United States Patent [19]

Helling et al.

[11] 4,353,980

[45] Oct. 12, 1982

[54] PROCESS FOR THE PRODUCTION OF PROTECTIVE LAYERS FOR PHOTOGRAPHIC MATERIALS

[75] Inventors: Günter Helling, Cologne; Karl Fuhr, Krefeld, both of Fed. Rep. of Germany

[73] Assignee: AGFA-Gevaert AG, Leverkusen, Fed. Rep. of Germany

[21] Appl. No.: 210,332

[22] Filed: Nov. 25, 1980

[30] Foreign Application Priority Data

Dec. 1, 1979 [DE] Fed. Rep. of Germany ..... 2948420

[51] Int. Cl.[3] ..... G03C 1/00

[52] U.S. Cl. ..... 430/532; 204/159.16; 204/159.18; 204/159.19; 427/44; 430/523; 430/536; 430/537; 430/906; 430/961

[58] Field of Search ..... 430/18, 532, 536, 537, 430/535, 533, 961, 906; 427/44; 204/159.16, 159.18, 159.19

[56] References Cited

U.S. PATENT DOCUMENTS

| | | | |
|---|---|---|---|
| 4,082,634 | 4/1978 | Chang | 430/270 |
| 4,092,173 | 5/1978 | Novak et al. | 430/906 |
| 4,120,721 | 10/1978 | Ketley | 430/284 |
| 4,171,979 | 10/1979 | Novak et al. | 430/449 |
| 4,248,958 | 2/1981 | Faust | 430/281 |

*Primary Examiner*—Mary F. Downey

*Attorney, Agent, or Firm*—Connolly and Hutz

[57] ABSTRACT

An improved abrasion and scratch resistance and resistance to chemicals of photographic materials is achieved by applying a coating composition comprising an irradiation-hardening binder, a multifunctional acrylic monomer, optionally a diiso- or polyisocyanate and a photoinitiator to the photographic material and subsequently irradiating the coating composition with light from the ultra-violet region of the spectrum.

9 Claims, No Drawings

PROCESS FOR THE PRODUCTION OF PROTECTIVE LAYERS FOR PHOTOGRAPHIC MATERIALS

This invention relates to a process for the production of protective layers for photographic materials which improve the mechanical properties of the materials and to a coating composition for producing these protective layers by the process according to the invention.

It is generally known that photographic materials may be provided with protective layers. The layers are intended either to protect the mechanically sensitive surfaces of the photographic materials against damage or to provide the surfaces of the materials with a certain texture which influences the reflection or sliding properties of the photographic materials in the required manner.

Thus, it is known for example from U.S. Pat. Nos. 2,798,004, 3,113,867 and 3,502,501 that photographic films may be provided with protective layers of acrylic acid, methacrylic acid or vinyl polymers which may be applied from aqueous solutions of from organic solvents. Matt or rough protective layers for photographic materials are known for example from German Pat. No. 1,202,136 or from U.S. Pat. Nos. 3,190,197; 3,415,670; 3,443,946 and 3,733,293. In U.S. Pat. Nos. 3,397,980 and 3,697,227, it is proposed to coat photographic films with laminates consisting of several plastic layers.

However, none of the protective layers described satisfies the requirements which photographic materials have to meet with regard to elasticity, scratch resistance, water-repellent properties and resistance to the liquids and solutions normally used in the home.

German Offenlegungsschrift No. 2,748,577 describes coating compositions for photographic materials which may be hardened by irradiation. The presence of ethylenically unsaturated carboxylic acids in these coating compositions is supposed to increase the abrasion resistance of the protective layers produced therefrom.

The disadvantage of the coating compositions containing these unsaturated carboxylic acids is that the protective layers produced therefrom are not sufficiently resistant to the aqueous agents and chemicals normally used in the home.

The protective or surface layers applied to photographic materials have to satisfy special requirements with regard to transparency and flexibility and, in addition, are required to show adequate scratch resistance. In addition, they have to adhere firmly to the surface of the photographic material and have to be resistant to liquids or solutions of the type commonly encountered in everyday life, such as for example coffee, ink, nail varnish remover, etc., in other words they must not be even discoloured by liquids such as these. In addition, the coating compositions are required to harden very quickly after application to the photographic material because it is only in this way that economic use is possible.

Although there is a considerable demand for protective layers of the type in question in the photographic field, efforts to find a layer composition which satisfies all of the abovementioned requirements have so far been unsuccessful.

The object of the present invention is to develop a protective layer composition which produces photographic protective layers characterised by improved abrasion and scratch resistance and resistance to chemicals.

The present invention relates to a process for the production of protective layers for photographic materials by applying and subsequently irradiating a coating composition which contains an acrylic compound and a photoinitiator and which is hardenable by irradiation with light from the ultra-violet region of the spectrum, characterised in that a coating composition comprising (A) at least one reaction product of a polyisocyanate, a polyol, a hydroxy acrylate and a polyol containing thio or dithio groups;

(B) at least one acrylic monomer containing at least two acrylic ester groups;

(C) at least one photoinitiator, optionally in conjunction with a compound accelerating the photoreaction, and (D) optionally at least one difunctional or higher isocyanate, is applied to the photographic material and subsequently irradiated.

The present invention also relates to a photographic silver halide material finished by the process according to the invention.

The reaction product (A) represents the irradiation-hardening binder of the coating composition. The reaction product contains organically bound sulphur in the form of thio and/or dithio groups in a quantity of from 0.01 to 10% by weight and preferably in a quantity of from 0.1 to 5% by weight, based on the weight of the reaction product.

In a preferred embodiment of the invention, the reaction product (A) has the following composition:

(a) 1 isocyanate gram equivalent of a polyisocyanate containing from 2 to 3 and, more particularly, 2 isocyanate groups per molecule, (b) from 0 to 0.7 hydroxyl gram equivalents of a polyol containing at least 2 and, more particularly, from 2 to 6 hydroxyl groups per molecule, free from organically bound sulphur, (c) from 0.01 to 0.7 hydroxyl gram equivalents of a hydroxyalkyl acrylate containing from 2 to 6 and, more particularly, from 2 to 4 carbon atoms in the alkyl group, (d) from 0.01 to 0.3 hydroxyl gram equivalents of a polyol containing thio or dithio groups and at least 2, more particularly from 2 to 4, hydroxyl groups per molecule.

The sum of the hydroxyl gram equivalents (b) to (d) amounts to between 1 and 1.2 whilst the content of organically bound sulphur, resulting from the thio and dithio groups, amounts to between 0.01 and 10% by weight and, more particularly, to between 0.1 and 5% by weight, all of these percentages being based on the weight of the reaction product.

The reaction product as such is known from German Offenlegungschrift No. 2,737,406 which also contains particulars of its production.

The incorporation of sulphur in the form of thio and/or dithio groups into urethane acrylates gives binders which are not only more reactive, but also, above all after hardening by irradiation, considerably more elastic than comparable sulphur-free binders. It does not matter how the sulphur is incorporated into the resin, i.e. whether in the form of thio(—S—) or dithio(—S—S—) groups. However, it is only in this form, i.e. in the formal oxidation stage one or two, that the sulphur develops its outstanding effectiveness with regard to the elasticity of the binder. Although the mere addition of the thio ethers to the binders has a reactivity-increasing effect, it does not have any influence on elasticity.

The reaction products (A) containing thio and/or dithio groups may be obtained by reacting a polyisocyanate containing from 2 to 3 and, more particularly, 2 isocyanate groups per molecule, a polyol containing at least 2 hydroxyl groups per molecule, a hydroxyalkyl acrylate and a polyol containing thio or dithio groups and at least 2 hydroxyl groups per molecule, as described in the above-mentioned German Offenlegungsschrift No. 2,737,406.

Component (B) of the coating composition according to the invention is formed by multifunctional acrylates or acrylic monomers containing at least two acrylic ester residues.

The following compounds are mentioned as examples of suitable acrylic monomers which provide the coating compositions according to the invention with the requisite hardness, increase the bond strength of the protective layers produced therefrom and accelerate their hardening: ethylene glycol diacrylate; ethylene glycol dimethacrylate; diethylene glycol diacrylate; glycerol diacrylate; glycerol triacrylate; trimethylol propane triacrylate; trimethylol propane trimethacrylate; triethylene glycol diacrylate; tetraethylene glycol dimethacrylate; 1,3-propane diol diacrylate; 1,3-propane diol dimethacrylate; 1,2,4-butane triol trimethacrylate; 1,3-butylene glycol diacrylate; 1,5-pentane diol dimethacrylate; 1,6-hexane diol diacrylate; 1,6-hexane diol dimethacrylate; pentaerythritol diacrylate; pentaerythritol triacrylate; 1,4-cyclohexane diol diacrylate; 1,4-cyclohexane diol dimethacrylate and neopentyl glycol diacrylate.

Component (B) of the coating compositions according to the invention is preferably formed by compounds of the type described in German Offenlegungsschrift No. 2,651,507. The compounds in question are polyfunctional acrylic acid esters of ethoxylated trimethylol propane having an average degree of ethoxylation of 2.5 to 4 and preferably from 3 to 4, the ethoxylated trimethylol propane being substantially free from trimethylol propane and having the following distribution:

4 to 5% by weight of monoethoxylation product,
14 to 16% by weight of diethoxylation product,
20 to 30% by weight of triethoxylation product,
20 to 30% by weight of tetraethoxylation product,
16 to 18% by weight of pentaethoxylation product,
6 to 8% by weight of hexaethoxylation product.

Component (D) of the coating composition according to the invention is a diisocyanatate or polyisocyanate. Isocyanates of this type are very effective adhesion promoters of the coating compositions according to the invention without themselves undesirably influencing the course of the hardening reaction. Component (D) may be omitted if no particular demands are made on the adhesion.

Suitable polyisocyanates are any aromatic and aliphatic diisocyanates such as, for example, 1,5-naphthylene diisocyanate; 4,4'-diphenyl methane diisocyanate; 4,4'-diphenyl dimethyl methane diisocyanate; dialkyl and tetraalkyl diphenyl methane diisocyanate; 4,4'-dibenzyl diisocyanate; 1,3-phenylene diisocyanate; 1,4-phenylene diisocyanate; the isomers of tolylene diisocyanate which may be used in admixture; chlorinated and brominated diisocyanates, preferably the aliphatic diisocyanates; butane-1,4-diisocyanate; hexane-1,6-diisocyanate; dicyclohexyl methane diisocyanate; cyclohexane-1,4-diisocyanate and 5-isocyanato-1-isocyanatomethyl-1,3,3-trimethyl cyclohexane. Trimerisation or oligomerisation products of polyisocyanates are particularly suitable.

As described above, the coating compositions according to the invention contain a binder (A) containing thio or dithio groups and crosslinkable by irradiation, a multi-functional acrylate (B) and optionally a diisocyanate or polyisocyanate (D). Now, it is even possible to use in the coating compositions according to the invention two or more irradiation-hardening binders containing thio or dithio groups as well as mixtures of two or more multifunctional acrylates (B) and mixtures of two or more polyisocyanates (D). Other substances which may be added with advantage to the coating compositions for purposes of modification are, for example monoacrylates, such as ethyl acrylate, glycidyl acrylate, butyl acrylate, 2-ethyl hexyl acrylate, hydroxy propyl acrylate, methacryloxy propyl trimethoxy silane or 4-chlorobutenyl methacrylate.

Reaction products of polyfunctional acrylates with amines, so-called accelerators, obtained in known manner by the addition of primary or secondary amines with the double bonds of polyfunctional acrylates (German Offenlegungsschrift No. 2,346,424) may also be added with advantage to the coating compositions according to the invention which may be hardened under the effect of photoinitiators. Additives such as these have the advantage of a high vapour pressure, i.e. they do not give off any unpleasant odours. In addition, they accelerate the hardening reaction and are also incorporated in the polymer network during the hardening reaction, thus preventing the accelerator from diffusing from the protective layer into adjoining layers.

The quantitative ratios in which the three components of the coating compositions according to the invention, (A), (B) and (D), are used are not critical. The irradiation-hardening binder (A) containing thio or dithio groups is generally used in quantities of from 5 to 65% by weight and preferably in quantities of from 15 to 45% by weight, based on the total weight of the coating composition; the multifunctional acrylate (B) is used in quantities of from 20 to 95% by weight and preferably in quantities of from 30 to 65% by weight and the diisocyanate or polyisocyanate (D) is used in quantities of from 1 to 15% by weight and preferably in quantities of from 2 to 6% by weight, based on the total weight of the coating composition. More specifically, the quantities used will depend upon the compounds used and upon the required properties of the photographic material to which the coating composition is applied. The most favourable quantitative ratios in these cases may be determined by simple tests.

Coating compositions which contain an irradiation-hardening binder containing thio or dithio groups, hexane diol diacrylate and also a triacrylate or a tetraethoxylated trimethylol propane and a trimerised hexamethylene diisocyanate have proved to be particularly advantageous in terms of transparency, hardness, scratch resistance, abrasion resistance, elasticity, bond strength and resistance to chemicals. Outstanding protective layers are provided by coating compositions which contain 29% by weight of a binder containing thio groups, 35% by weight of hexane diol diacrylate as well as 14% by weight of a triacrylate of a tetraethoxylated trimethylol propane, 3% by weight of a trimerised hexamethylene diisocyanate and in which the remaining 19% by weight consist of additives such as, for example, acrylates, UV-absorbers, photoinitiators, matting agents, wetting agents, organic resins or silicone oils.

Before they are coated with protective layers according to the invention, the photographic materials are subjected to the processing steps specific to them. After the final processing step, the protective layers are applied and hardened by irradiation. These two process steps may be carried out either continuously or at intervals.

The protective layers may be applied to the photographic materials by the usual methods. The coating composition may be applied for example by dip coating, by means of an air knife, by means of rollers, a grooved coating knife, by the so-called curtain coating process or by the air-brush process.

The quantity of coating composition applied wet to a photographic material generally amounts to between 2 and 20 cc per square meter of surface area. In most cases, the desired effect will be achieved with a wet coating of from about 3 to 10 cc of coating composition per square meter. The viscosities suitable for applying the coating compositions by the usual methods are in the range from 25 to 1000 cPs and, more particularly, in the range from 75 to 200 cPs.

Whether a photographic material to be finished with the protective layers according to the invention is in the form of a relatively long continuous web or in the form of individual pieces, i.e. sheets, will depend upon the suitability of one or the other process and upon the technical means available. In addition, photographic materials may be finished with the protective layers according to the invention on one or both sides. In the case of reflective photographic materials, coating on one side, for example the image side, will be sufficient, whereas transparent photographic materials, such as for example reversal films or motion picture films, will require coating on both sides.

Suitable photoinitiators, component (C) of the coating compositions according to the invention, are for example benzophenone and, quite generally, aromatic ketone compounds derived from benzophenone, such as alkyl benzophenones, halogen-methylated benzophenones of the type described in German Offenlegungsschrift No. 1,949,010, Michlers ketone, anthrone or halogenated benzophenones. Other suitable photoinitiators are benzoin and its derivatives, as described in German Offenlegungsschrifts Nos. 1,769,168; 1,769,853; 1,769,854; 1,807,297; 1,807,301; 1,916,678; 2,430,081 and in German Auslegeschrift No. 1,694,149. It is also possible to use anthraquinone and many of its derivatives, for example β-methyl anthraquinone, tert.-butyl anthraquinone and anthraquinone carboxylic acid esters or the oxime esters described in German Offenlegungsschrift No. 1,795,089.

The above-mentioned photoinitiators, which may be used in quantities of from 0.1 to 20% by weight and preferably in quantities of from 3 to 10% by weight, based on the polymerisable constituents of the composition, depending on the purpose for which the coating compositions are to be used, may be used either as individual substances or, since many of them show advantageous synergistic effects, even in combination with one another.

It may be of advantage to use other additives either to improve the film-forming properties of the resin compositions or to obtain a particularly scratch-resistant surface of the layer. Thus, admixture with other resins, for example with saturated or unsaturated polyesters, is possible. Resins of this type are preferably used in quantities of from 1 to 50% by weight, based on the polymerisable constituents of the coating composition. Basically, however, the resins used should be of such a type and used in such limited quantities that the reactivity of the component crosslinkable by irradiation is not adversely affected. Resins suitable for use as additives such as these are described for example in E. Karsten's Lackrohstofftabellen, 5th Edition, Curt R. Vincentz Verlag, Hannover, 1972, pages 74 to 106, 195 to 258, 267 to 293, 335 to 347, 357 to 366.

Additives capable of advantageously increasing the reactivity of the coating compositions are certain tertiary amines such as, for example, triethylamine or triethanolamine. Particularly suitable additives of this type are polymerisable tertiary amines such as, for example, reaction products of a triacrylate of a tetraethoxylated trimethylol propane and diethyl amine. The compounds mentioned are preferably used in quantities of from 0 to 25% by weight, based on the polymerisable part of the coating composition.

Suitable radiation sources with which the applied protective layers according to the invention may be hardened are artificial light sources emitting in the range from 2500 to 5000 A and preferably in the range from 3000 to 4000 A. It is of advantage to use mercury vapour, xenon and tungsten lamps, particularly high pressure mercury lamps.

The protective layers produced from the coating compositions according to the invention in a thickness of 1 μm and 0.1 mm (1 $\mu m = 10^{-3}$ mm) can generally be hardened in less than one second when irradiated with the light of a high pressure mercury lamp delivering approximately 30 to 200 watts per cm of length and arranged at a distance of about 8 cm.

In cases where the coating compositions according to the invention are used for producing protective layers on exposed and developed photographic papers, it is frequently desirable to product matt surfaces. To this end, it is possible to add to the coating composition fillers or matting agents the absorption behaviour of which does not interfere with the polymerisation process. Suitable additives of this type are, for example, silicates, glass powder, microcrystalline wax, microcapsules which may contain various substances, particularly UV-absorbers, or light-permeable crosslinked or uncrosslinked polymer particles which are insoluble in the coating composition.

The irradiation of the protective layers which results in their hardening does not have any adverse effect upon the recording layers lying beneath the protective layer, even in the case of a colour photographic material.

The coating compositions according to the invention may not only be used for the production of protective layers for standard photographic recording materials consisting of a support layer and recording and auxiliary layers applied thereto, they may also be applied to materials which do not contain an image layer or an image-forming layer and from which a photographic material with an image layer or image-forming layer is produced in another process step.

The invention is illustrated by the following Examples.

Preparation A1

A binder containing thio groups was produced by reacting 111 g of isophorone diisocyanate (0.5 mole) with 46.4 g of hydroxy ethyl acrylate (0.4 mole), 6.1 g of thiodiglycol (0.05 mole) and 134 g of an ethoxylated trimethylol propane having a hydroxyl number of 250 (molecular weight 675).

After all the isocyanate had been introduced, the thiodiglycol was added dropwise with stirring and cooling over a period of 2 hours at 40° to 50° C. The reaction temperature of 60° C. was not exceeded during the dropwise addition. Following the addition of 0.4 g of tin octoate and 0.15 g of benzoquinone the hydroxy ethyl acrylate was added dropwise with cooling at 50° to 60° C. in such a way that the temperature did not exceed 65° C., air being passed over during the addition. After an NCO-value of around 14% by weight had been reached after about 4 hours, the ethoxylated trimethylol propane was added in portions.

The mixture was then stirred at 60° C. while dry air was passed over until the NCO-value amounted to 0.1% by weight. A colourless and odourless medium-viscosity resin was formed.

Preparation A2

A prepolymeric urethane acrylate was produced in the same way as preparation A, except that 22.4 g of a polyester of triethylene glycol and methylene-bis-thioglycolic acid (OH-number 250) were used instead of 6.1 g of thiodiglycol.

EXAMPLE 1

A coating composition was prepared by adding the triacrylate of a tetraethoxylated trimethyl propane, trimerised hexamethylene isocyanate, an addition product of the triacrylate of a tetraethoxylated trimethylol propane and diethyl amine, hexane diol diacrylate, benzophenone and benzil dimethyl ketal to the binder produced as preparation A1.

The coating composition had the following constitution:

binder—29.0% by weight
hexane diol diacrylate—34.5% by weight
triacrylate of a tetraethoxylated trimethylol propane—14.0% by weight
trimerised hexamethylene diisocyanate—2.5% by weight
addition product of the triacrylate of a tetraethoxylated trimethylol propane and diethyl amine—14.0% by weight
benzophenone—5.0% by weight
benzil dimethyl ketal—1.0% by weight The coating composition was applied to exposed, developed and dried colour photographic paper in the form of a 10 μm thick layer using a grooved coating knife. The coated paper was then guided past a high pressure mercury lamp with a power consumption of 80 W/cm on a conveyor belt travelling at a speed of 20 meters per minute, as a result of which the coating composition hardened to form a transparent, flexible, scratch-resistant and chemically resistant layer.

EXAMPLE 2

A coating composition having the following constitution was prepared: p1 binder corresponding to preparation A1—26.5% by weight
hexane diol diacrylate—50.2% by weight
hexamethylene diisocyanate—4.6% by weight
addition product of the triacrylate of a tetraethoxylated trimethylol propane and diethyl amine—13.2% by weight
benzophenone—4.5 % by weight
benzil dimethyl ketal—1.0% by weight In the same way as in Example 1, a processed colour photographic paper was coated and hardened using two high pressure mercury lamps arranged one behind the other, each with a power consumption of 80 W/cm (belt speed 50 meters per minute). A transparent, firmly adhering, scratch resistant coating unaffected by a dye solution (fountain pen ink) was obtained.

EXAMPLE 3

The following coating composition was prepared:

binder corresponding to preparation A2—26.5% by weight
trimethylol propane triacrylate—50.2% by weight
triacrylate of a tetraethoxylated trimethylol propane—10.2% by weight
hexamethylene diisocyanate—3.0 % by weight
benzophenone—5.5% by weight
N,N-dimethyl hexyl amine—4.6% by weight A colour photographic material of a polyethylene terephthalate support layer and gelatin silver halide emulsion layers applied thereto was exposed and developed, coated with the coating composition on both sides and hardened by irradiation with a mercury vapour lamp (power consumption 80 W/cm) for a period of 5 seconds. The hardened coating thus applied to both sides of the material weighed 16 g/m$^2$ on each side. Hardening of the layers applied with UV-light produced transparent, flexible, scratch-resistant and firmly adhering protective layers.

EXAMPLE 4

An exposed positive cine film consisting of a cellulose triacetate support and gelatin silver halide emulsion layers applied thereto was developed and dried. A coating composition having the following constitution was then applied to both sides of the film:

binder corresponding to preparation A1—32.5% by weight
hexane diol diacrylate—50% by weight
trimerised hexamethylene diisocyanate—5.5% by weight
benzophenone—5.2% by weight
benzil dimethyl ketal—3.0% by weight
N,N-dimethyl hexyl amine—3.8% by weight The protective layers applied on both sides were hardened in the same way as in Example 1, resulting in the formation of transparent, flexible and scratch-resistant coatings of which the bond strength both to the support layer side and also to the emulsion side of the cine film was excellent.

EXAMPLE 5

Example 1 was repeated. The coating composition was modified to the extent that 7.8% by weight of an $SiO_2$-sol was added as matting agent to the composition indicated in Example 1. The result was a paper surface having a matt and, in addition, flexible, scratch-resistant and firmly adhering protective layer.

EXAMPLE 6

The procedure was described in Example 1, except that 2% by weight of silicone oil was added to the coating composition. The coating thus obtained showed particularly low sliding friction in addition to the advantageous properties indicated in Example 1.

COMPARISON EXAMPLE

The coating composition according to Example 1 of German Offenlegungsschrift No. 2,748,577 was used for the comparison.

The coating compositions indicated in the following Table were applied in the form of 10 μm thick layers by means of a grooved coating knife to the layer side of an exposed, developed, rinsed and dried colour photographic paper. The layers thus applied were then hardened as described in Example 1. A drop of ink was then applied to the white image areas of the photographic papers coated with the protective layers and, after 3 minutes, was rinsed off again with water. The papers were then wiped with a damp cloth. Comparison of the samples showed that the ink could easily be removed from the samples treated with coating compositions according to the invention, whereas a distinct blue-coloured stain was left behind on the comparison sample. A non-coated paper additionally used for comparison was heavily stained under the same conditions.

The staining of the papers was determined by measuring the colour densities. The colour density values set out in the following Table are a measure of the protective effect which can be obtained with the protective layers.

| Example No. | Colour density |
|---|---|
| 1 | 0.02 |
| 2 | 0.06 |
| 3 | 0.05 |
| 4 | 0.07 |
| 5 | 0.03 |
| 6 | 0.03 |
| Comparison Example | 0.78 |
| Uncoated paper | 2.85 |

A colour density of less than 0.08 indicates that there was no staining, i.e. the surface is completely sealed.

We claim:

1. A process for the production of protective layers for photographic materials by applying and subsequently irradiating a coating composition which contains an acrylic compound and a photoinitiator and which is hardenable by irradiation with light from the ultra-violet region of the spectrum, characterized in that a coating composition comprising (A) at least one reaction product of a polyisocyanate, a hydroxy acrylate a polyol containing thio or dithio groups and optionally a polyol, (B) at least one acrylic monomer containing at least two acrylic ester groups and (C) at least one photoinitiator, either with or without a compound accelerating the photoreaction is applied to at least one side of the photographic material and subsequently irradiated.

2. A process as claimed in claim 1, characterized in that a coating composition comprising (A) at least one reaction product of a polyisocyanate, a hydroxy acrylate, a polyol containing thio or dithio groups and optionally a polyol, (B) at least one acrylic monomer containing at least two acrylic ester groups, (C) at least one photoinitiator, either with or without a compound accelerating the photoreaction, and (D) at least one difunctional or higher isocyanate is applied to at least one side of the photographic material and subsequently irradiated.

3. A process as claimed in 1 or 2, characterised by the use of a reaction product (A) containing (a) one isocyanate-gram equivalent of a polyisocyanate containing from 2 to 3, and, more particularly, two isocyanate groups per molecule, (b) from 0 to 0.7 hydroxyl-gram equivalents of a polyol containing at least 2 and, more particularly, from 2 to 6 hydroxyl groups per molecule, free from organically bound sulphur, (c) from 0.01 to 0.7 hydroxyl-gram equivalents of a hydroxyalkyl acrylate containing from 2 to 6 and, more particularly, from 2 to 4 carbon atoms in the alkyl group, (d) from 0.01 to 0.3 hydroxyl-gram equivalents of a polyol containing thio or dithio groups and at least two, more particularly from 2 to 4, hydroxyl groups per molecule, the sum of the hydroxyl gram equivalents (b) to (d) amounting to between 1 and 1.2 and the content of organically bound sulphur, resulting from the thio and dithio groups, amounting to between 0.01 and 10% by weight and, more particularly, to between 0.1 and 5% by weight, always based on the weight of the reaction product.

4. A process as claimed in claims 1 or 2, characterized in that the acrylic monomer (B) is an acrylic acid ester or ethoxylated trimethylol propane which has an average degree of ethoxylation of from 2.5 to 4 and preferably from 3 to 4 and which contains at most residual amounts of trimethylol propane.

5. A process as claimed in claims 1 or 2, characterised in that 1,6-hexane diol diacrylate is used as the acrylic monomer (B).

6. A process as claimed in claims 1 or 2, characterised in that a mixture of, based on the weight of the reaction product, 14% by weight of the acrylic monomer defined in claim 4 and 34% by weight of 1,6-hexane diol diacrylate is used as the acrylic monomer (B).

7. A process as claimed in claim 2, characterised in that an aliphatic isocyanate containing 2 or 3 isocyanate groups is used as the isocyanate (D).

8. A process as claimed in claim 1, characterised in that the coating composition contains from 15 to 45% by weight of the component (A) and from 30 to 65% by weight of the component (B), based on its total weight.

9. A process as claimed in claim 2, characterised in that the coating composition contains from 2 to 6% by weight of the component (D), based on its total weight.

* * * * *